US011268733B2

(12) United States Patent
Wu

(10) Patent No.: US 11,268,733 B2
(45) Date of Patent: Mar. 8, 2022

(54) COMPRESSOR CONTROL SYSTEM AND AIR CONDITIONER FOR WIDE-RANGE TEMPERATURE ADJUSTMENT

(71) Applicant: Wuyi University, Jiangmen (CN)

(72) Inventor: Min Wu, Jiangmen (CN)

(73) Assignee: Wuyi University, Jiangmen (CN)

( * ) Notice: Subject to any disclaimer, the term of this patent is extended or adjusted under 35 U.S.C. 154(b) by 107 days.

(21) Appl. No.: 16/840,865

(22) Filed: Apr. 6, 2020

(65) Prior Publication Data

US 2021/0254854 A1 Aug. 19, 2021

(30) Foreign Application Priority Data

Feb. 18, 2020 (CN) ..... 2020101001613

(51) Int. Cl.
*F24F 11/86* (2018.01)
*F24F 11/49* (2018.01)

(52) U.S. Cl.
CPC ..... *F24F 11/86* (2018.01); *F24F 11/49* (2018.01)

(58) Field of Classification Search
CPC . F24F 11/49; F24F 11/86; F25B 49/02; F25B 2600/024; F25B 2700/2104
See application file for complete search history.

(56) References Cited

U.S. PATENT DOCUMENTS 4,640,183 A * 2/1987 Doi ..... B60H 1/00835 454/75
5,918,469 A * 7/1999 Cardella ..... F25B 21/02 62/3.7
6,865,899 B2 * 3/2005 Nam ..... F25D 17/045 62/187
10,684,053 B2 * 6/2020 Walser ..... F25B 13/00
10,704,808 B2 * 7/2020 Takahashi ..... F25D 19/04

FOREIGN PATENT DOCUMENTS

CN 212777690 * 3/2021

* cited by examiner

*Primary Examiner* — Marc E Norman
(74) *Attorney, Agent, or Firm* — Vivacqua Crane PLLC

(57) ABSTRACT

Disclosed are a compressor control system and an air conditioner for wide-range temperature adjustment. The control system includes a power supply, a compressor, a main board, and a first temperature sensor. The power supply is configured to generate a power input voltage. A power voltage input circuit is disposed between the compressor and the power supply. The main board is electrically connected to the power voltage input circuit. During operation, the main board is configured to control connection and disconnection of the power voltage input circuit. The first temperature sensor is configured to detect an indoor temperature, the first temperature sensor is electrically connected to the main board and transmits an electrical signal to the main board, and the first temperature sensor is electrically connected to a first fixed-value resistor.

16 Claims, 3 Drawing Sheets

COMPRESSOR CONTROL SYSTEM AND AIR CONDITIONER FOR WIDE-RANGE TEMPERATURE ADJUSTMENT

CROSS-REFERENCE TO RELATED APPLICATIONS

This application is based on and claims the benefit of priority from Chinese Patent Application No. 2020101001613, filed on Feb. 18, 2020, the entirety of which is incorporated by reference herein.

TECHNICAL FIELD

The present disclosure relates to the field of refrigeration device technologies, and specifically, to a compressor control system and an air conditioner for wide-range temperature adjustment.

BACKGROUND

An air conditioner complies with the following principle: A compressor compresses a gas refrigerant into a high-temperature and high-pressure gas refrigerant, and transfers the gas refrigerant to a condenser of an air conditioner outdoor unit to become a liquid refrigerant. The liquid refrigerant enters an evaporator through a capillary tube to absorb heat in indoor air and is then vaporized into the gas refrigerant. The gas refrigerant is transferred back to the compressor for further compression, thereby continually performing cyclic refrigeration.

An existing air conditioner can implement a freezing function after being improved, that is, enable a lowest refrigeration temperature to be less than 0° C. However, as shown in FIG. 1, a compressor of the existing air conditioner is electrically connected to a main board, and the main board is electrically connected to an indoor ambient temperature-based negative temperature coefficient (NTC) thermistor. The indoor ambient temperature-based NTC thermistor transmits, based on a specified operating state, a resistance that varies with a detected indoor ambient temperature, so as to automatically start or stop, or convert a frequency. When an indoor ambient temperature is less than 15° C., a resistance of the indoor ambient temperature-based NTC thermistor used on the existing air conditioner increases. Consequently, a low-level signal is transmitted to the main board, and the compressor is controlled to stop working. In other words, the compressor does not perform refrigeration at an ambient temperature lower than 15° C., and cannot meet a demand of implementing the freezing function by transforming a common household air conditioner to perform refrigeration in a small confined space to reach a subzero temperature.

SUMMARY

The present disclosure is to resolve at least one of the technical problems in related technologies to some extent. For this, the present disclosure provides a compressor control system and an air conditioner for wide-range temperature adjustment, so that a compressor can operate normally at an indoor temperature less than 0° C., and a common air conditioner can be transformed to have a freezing function.

According to embodiments of a first aspect of the present disclosure, a compressor control system includes a power supply, configured to generate a power input voltage; a compressor, where a power voltage input circuit is disposed between the compressor and the power supply; a main board, electrically connected to the power voltage input circuit, where during operation, the main board is configured to control connection and disconnection of the power voltage input circuit; and a first temperature sensor, configured to detect an indoor temperature, where the first temperature sensor is electrically connected to the main board and transmits an electrical signal to the main board, and the first temperature sensor is electrically connected to a first fixed-value resistor.

The compressor control system according to the embodiments of the present disclosure has at least the following technical effect: The first temperature sensor is electrically connected to the first fixed-value resistor, and a resistance of the first fixed-value resistor is a constant. Relative to a characteristic that a resistance of an existing indoor ambient temperature-based NTC thermistor decreases with a temperature rise and increases with a temperature drop, the resistance of the first fixed-value resistor corresponding to the first temperature sensor does not change with a temperature rise or drop, so that the electrical signal transmitted by the first temperature sensor to the main board is always a high-level signal, and after the indoor temperature falls below 15° C., the main board does not control the power voltage input circuit to be disconnected. It is ensured that when the indoor temperature is lower than 0° C., the main board can still control the power voltage input circuit to be connected, so that the compressor can operate normally at an indoor temperature lower than 0° C., thereby providing a condition for transforming a common air conditioner into an air conditioner with the freezing function.

According to some embodiments of the present disclosure, a first temperature sensing probe is disposed at one end of the first temperature sensor, the first fixed-value resistor is disposed in the first temperature sensing probe, and a first male connector is disposed at an end of the first temperature sensor that is away from the first temperature sensing probe; and a first female connector that matches the first male connector is disposed on the main board.

According to some embodiments of the present disclosure, a resistance of the first fixed-value resistor is equal to a resistance of an indoor ambient temperature-based NTC thermistor at 25° C.

According to some embodiments of the present disclosure, a first relay is disposed in the power voltage input circuit, the first relay is electrically connected between the main board and the compressor, and upon power-on, the main board controls the first relay to close, so that the compressor accesses the power supply through the power voltage input circuit.

According to some embodiments of the present disclosure, an intelligent temperature controlled switch is serially connected on a circuit between the power supply and the first temperature sensor, and when an indoor temperature reaches a specified refrigeration temperature, the intelligent temperature controlled switch controls the compressor to stop operation.

According to some embodiments of the present disclosure, the compressor control system further includes a coil temperature sensor for detecting a tube wall temperature of at least one of an evaporator and a condenser, where a second fixed-value resistor is disposed in the coil temperature sensor, and the coil temperature sensor is electrically connected to the main board and transmits an electrical signal to the main board.

According to some embodiments of the present disclosure, the compressor control system further includes a third temperature sensor for detecting an aluminum fin temperature of the evaporator and/or the condenser, where the third temperature sensor is electrically connected to a third fixed-value resistor, and the third temperature sensor is electrically connected to the main board and transmits an electrical signal to the main board.

According to some embodiments of the present disclosure, a coil temperature sensing probe is disposed at one end of the coil temperature sensor, the second fixed-value resistor is disposed in the coil temperature sensing probe, the other end of the coil temperature sensor is connected to a second male connector, and a second female connector that matches the second male connector is disposed on the main board; and a third temperature sensing probe is disposed at one end of the third temperature sensor, the third fixed-value resistor is disposed in the third temperature sensing probe, and the other end of the third temperature sensor is electrically connected to the second male connector.

According to some embodiments of the present disclosure, a resistance of the second fixed-value resistor is equal to a resistance of a coil temperature-based NTC thermistor at 25° C.; and a resistance of the third fixed-value resistor is equal to the resistance of the coil temperature-based NTC thermistor at 25° C.

According to embodiments of a second aspect of the present disclosure, an air conditioner for wide-range temperature adjustment includes a compressor, an evaporator, and a condenser that are sequentially connected through a duct to form a circulation loop, where an expansion valve is disposed between the evaporator and the condenser, and the compressor is controlled by any one of the foregoing control systems.

The air conditioner for wide-range temperature adjustment according to the embodiments of the present disclosure has at least the following technical effect: The first temperature sensor is electrically connected to the first fixed-value resistor, and the resistance of the first fixed-value resistor is a constant. Relative to a characteristic that a resistance of an existing indoor ambient temperature-based NTC thermistor decreases with a temperature rise and increases with a temperature drop, the resistance of the first fixed-value resistor corresponding to the first temperature sensor does not change with a temperature rise or drop, so that the electrical signal transmitted by the first temperature sensor to the main board is always a high-level signal, and after the indoor temperature falls below 15° C., the main board does not control the power voltage input circuit to be disconnected. It is ensured that when the indoor temperature is lower than 0° C., the main board can still control the power voltage input circuit to be connected, so that the compressor can operate normally at an indoor temperature lower than 0° C. Further, in this way, the air conditioner in the embodiments of the present disclosure can perform refrigeration for the indoor temperature to fall below 0° C., featuring a wide temperature adjustment range. Compared with an existing common household air conditioner, the air conditioner in the embodiments of the present disclosure can not only implement a common refrigeration function but also be used as a freezer to perform refrigeration in a small confined space to reach −20° C.

Some additional aspects and advantages of the present disclosure are provided in the following descriptions, are clear in the following descriptions, or are understandable through practice of the present disclosure.

BRIEF DESCRIPTION OF THE DRAWINGS

The foregoing and/or additional aspects and advantages of the present disclosure are clear and comprehensible in the following descriptions of embodiments with reference to the accompanying drawings.

REFERENCE SIGNS IN THE DRAWINGS

1: indoor ambient temperature-based NTC thermistor; 2: coil temperature-based NTC thermistor;

100: main board; 110: first female connector; 120: second female connector;

200: first temperature sensor; 210: first temperature sensing probe; 220: first male connector; 230: first fixed-value resistor;

300: evaporator;

400: coil temperature sensor; 410: coil temperature sensing probe 420:

second male connector;

500: third temperature sensor; 510: third sensor; 520: second fixed-value resistor;

600: power supply;

700: compressor;

800: power voltage input circuit; 810: first relay; and

900: intelligent temperature controlled switch.

DETAILED DESCRIPTION

This specification describes in detail specific embodiments of the present disclosure. Example embodiments of the present disclosure are illustrated in the accompanying drawings. The accompanying drawings are intended to supplement the descriptions of the specification with graphics, so that each technical feature and an overall technical solution of the present disclosure can be intuitively and visually understood, but cannot be construed as a limitation on the protection scope of the present disclosure.

In the descriptions of the present disclosure, it should be understood that directions or position relationships indicated by direction-related descriptions "up", "down", "front", "rear", "left", "right", and the like are based on directions or position relationships shown by the accompanying drawings, which are used only for describing the present disclosure and for description simplicity, but do not indicate or imply that an indicated apparatus or element must have a specific direction or must be constructed and operated in a specific direction. Therefore, this cannot be understood as a limitation on the present disclosure.

In the descriptions of the present disclosure, the terms "first" "second", and "third" are merely intended to distinguish between technical features, and shall not be understood as an indication or implication of relative importance or an implicit indication of the number of indicated technical features or an implicit indication of the sequence of indicated technical features.

In the descriptions of the present disclosure, unless otherwise specifically limited, terms such as "dispose", "install", and "connect" should be understood in a broad sense. A person skilled in the art can properly determine specific meanings of the foregoing terms in the present disclosure with reference to specific content of the technical solutions.

Figure 2:
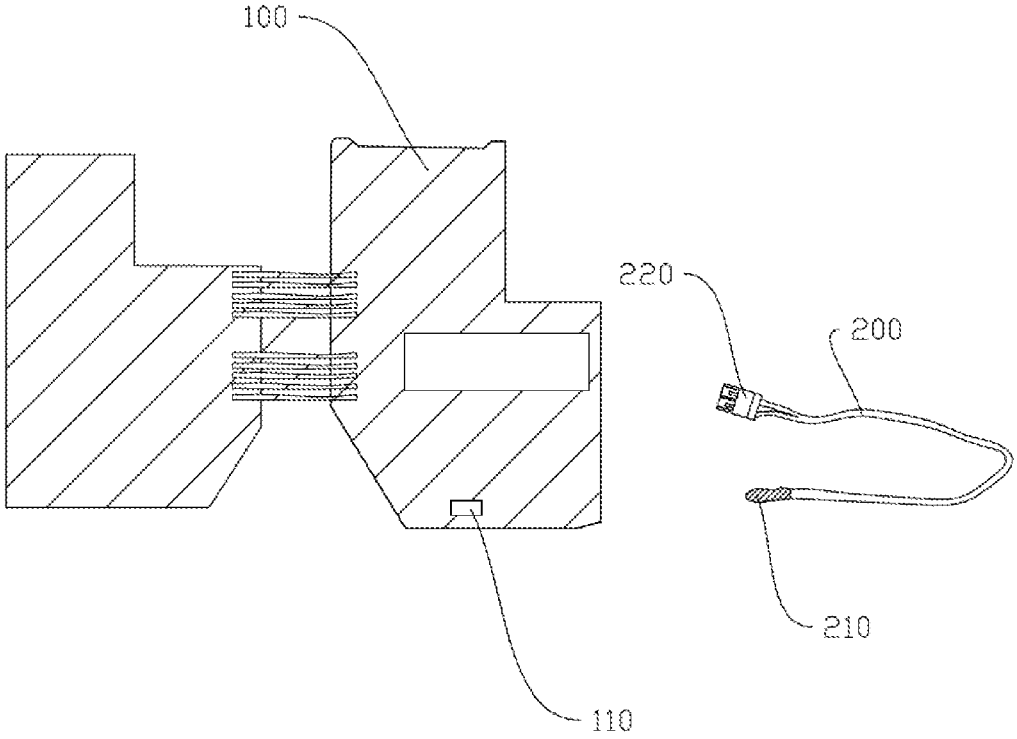
FIG. 2 is a schematic structural diagram of assembling a main board and a first temperature sensor according to an embodiment of the present disclosure.
Figure 4:
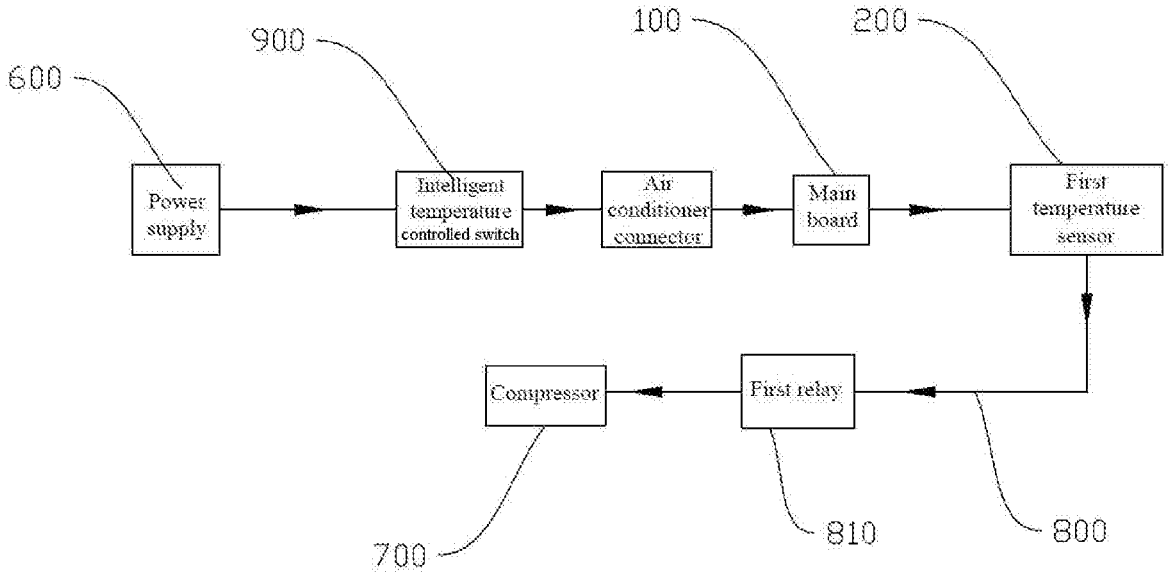
FIG. 4 is a schematic diagram of a principle according to an embodiment of the present disclosure.
Figure 5:
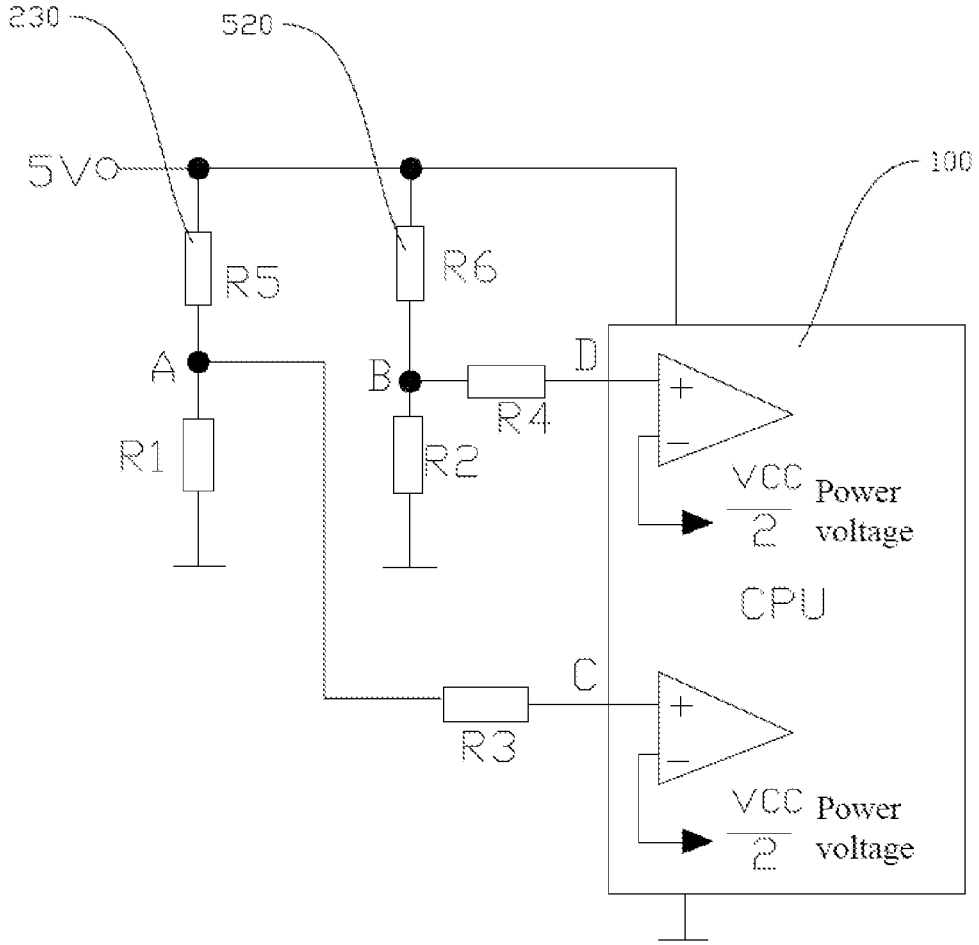
FIG. 5 is a schematic diagram of a compressor control circuit according to an embodiment of the present disclosure.

Referring to FIG. 2, FIG. 4, and FIG. 5, a compressor control system according to embodiments of the present disclosure includes a power supply 600, a compressor 700, a main board 100, and a first temperature sensor 200. The power supply 600 is configured to generate a power input voltage. A power voltage input circuit 800 is disposed between the compressor 700 and the power supply 600. The main board 100 is electrically connected to the power voltage input circuit 800. During operation, the main board 100 is configured to control connection and disconnection of the power voltage input circuit 800. The first temperature sensor 200 is configured to detect an indoor temperature. The first temperature sensor 200 is electrically connected to the main board 100 and transmits an electrical signal to the main board 100. The first temperature sensor 200 is electrically connected to a first fixed-value resistor 230. Compared with the existing technology, in the embodiments of the present disclosure, the first temperature sensor 200 is electrically connected to the first fixed-value resistor 230, and a resistance of the first fixed-value resistor 230 is a constant. Relative to a characteristic that a resistance of an existing indoor ambient temperature-based NTC thermistor 1 decreases with a temperature rise and increases with a temperature drop, the resistance of the first fixed-value resistor 230 corresponding to the first temperature sensor 200 does not change with a temperature rise or drop, so that the electrical signal transmitted by the first temperature sensor 200 to the main board 100 is always a high-level signal, and after the indoor temperature falls below 15° C., the main board 100 does not control the power voltage input circuit 800 to be disconnected. It is ensured that when the indoor temperature is lower than 0° C., the main board 100 can still control the power voltage input circuit 800 to be connected, so that the compressor 700 can operate normally at an indoor temperature lower than 0° C., thereby providing a condition for transforming a common air conditioner into an air conditioner with a freezing function.

In some embodiments of the present disclosure, a first temperature sensing probe 210 is disposed at one end of the first temperature sensor 200, the first fixed-value resistor 230 is disposed in the first temperature sensing probe 210, and a first male connector 220 is disposed at an end of the first temperature sensor 200 that is away from the first temperature sensing probe 210; and a first female connector 110 that matches the first male connector 220 is disposed on the main board 100. With such disposition, the first male connector 220 is plug-connected to the first female connector 110 for coordination, and therefore the first temperature sensor 200 can be electrically connected to the main board 100 and can transmit an electrical signal to the main board 100 by using a data cable. The transmission is stable, and assembly and disassembly are convenient, thereby facilitating maintenance and replacement. In addition, the first fixed-value resistor 230 is disposed in the first temperature sensing probe 210, so that a structure of the first temperature sensor 200 can be further miniaturized, and the first fixed-value resistor 230 can be prevented from being exposed on an external surface or being easily damaged.

In some embodiments of the present disclosure, a resistance of the first fixed-value resistor 230 is equal to a resistance of an indoor ambient temperature-based NTC thermistor 1 at 25° C. The indoor ambient temperature-based NTC thermistor 1 is a temperature sensor for detecting an indoor temperature on a common household air conditioner in an existing market. A resistance of the indoor ambient temperature-based NTC thermistor 1 decreases with a temperature rise and increases with a temperature drop. The indoor ambient temperature-based NTC thermistor 1 detects an indoor ambient temperature based on a specified operating state, so that the main board 100 can be used to control the compressor 700 to automatically start or stop, or convert a frequency. It should be noted that, a specified temperature range of the indoor ambient temperature-based NTC thermistor 1 is generally 15° C.-30° C. Therefore, no refrigeration is performed at an ambient temperature lower than 15° C., and no heating is performed at an ambient temperature higher than 30° C. In the industry, the resistance of the indoor ambient temperature-based NTC thermistor 1 of an air conditioner at 25° C. is referred to as a nominal value. That is, the resistance of the indoor ambient temperature-based NTC thermistor 1 at 25° C. enables the electrical signal transmitted to the main board 100 to always stay at a high level. In a normal process, the compressor 700 sets the resistance of the first fixed-value resistor 230 to be equal to the resistance of the indoor ambient temperature-based NTC thermistor 1 at 25° C. Therefore, the resistance of the first fixed-value resistor 230 is a constant and does not change with the indoor temperature, so that the electrical signal transmitted by the first temperature sensor 200 to the main board 100 always stays at a high level. It is ensured that when the indoor temperature is lower than 0° C., the main board 100 can still control the power voltage input circuit 800 to be connected, so that the compressor 700 can operate normally at an indoor temperature lower than 0° C., thereby providing a condition for transforming the common air conditioner into an air conditioner with the freezing function.

In some embodiments of the present disclosure, a first relay 810 is disposed in the power voltage input circuit 800, the first relay 810 is electrically connected between the main board 100 and the compressor 700, and upon power-on, the main board 100 controls the first relay 810 to close, so that the compressor 700 accesses the power supply 600 through the power voltage input circuit 800. The first relay 810 is a normally open relay. When the main board 100 is not powered on, the first relay 810 is not closed, and the power voltage input circuit 800 is disconnected, so that the compressor 700 stops operation. When the main board 100 is powered on, the first relay 810 is closed, and the power voltage input circuit 800 is connected, so that the compressor 700 operates normally. The main board 100 implements power-on based on the electrical signal transmitted by the first temperature sensor 200, so as to control the compressor 700 to operate normally or stop operation. Preferably, a CPU that is electrically connected to the first temperature sensor 200 is disposed on the main board 100, and the CPU receives the electrical signal transmitted by the first temperature sensor 200 and controls the first relay 810 to open or close. The CPU receives and responds to a signal quickly, and can accurately and quickly perform judgment on the electrical signal transmitted by the first temperature sensor 200 and control the first relay 810 to close or open, so as to automatically control the compressor 700 to start or stop.

As shown in FIG. 4, an intelligent temperature controlled switch 900 is serially connected on a circuit between the power supply 600 and the first temperature sensor 200, and when an indoor temperature reaches a specified refrigeration temperature, the intelligent temperature controlled switch 900 controls the compressor 700 to stop operation. An existing model on the market is selected as the intelligent temperature controlled switch 900. The intelligent temperature controlled switch 900 can input a refrigeration temperature to control software inside the intelligent temperature controlled switch 900 by using a key. The intelligent temperature controlled switch 900 can also automatically detect an indoor temperature. When the indoor temperature drops to the specified refrigeration temperature, the intelligent temperature controlled switch 900 becomes open, so that the power voltage input circuit 800 is disconnected, and consequently the compressor 700 stops operation This is convenient to accurately control indoor refrigeration to reach the required refrigeration temperature, thereby meeting temperature requirements for freezing different products. As shown in FIG. 4, specifically, the intelligent temperature controlled switch 900 is plug-connected to a household socket, and then an air conditioner connector is inserted into the intelligent temperature controlled switch 900. It can be understood that the power supply 600 refers to a 220 V household circuit, and the household socket refers to an interface for connecting to the power supply 600. Therefore, the intelligent temperature controlled switch 900 is plug-connected to the household socket, and then the air conditioner connector is inserted into the intelligent temperature controlled switch 900, so as to implement connection between an air conditioner and the household circuit.

Figure 3:
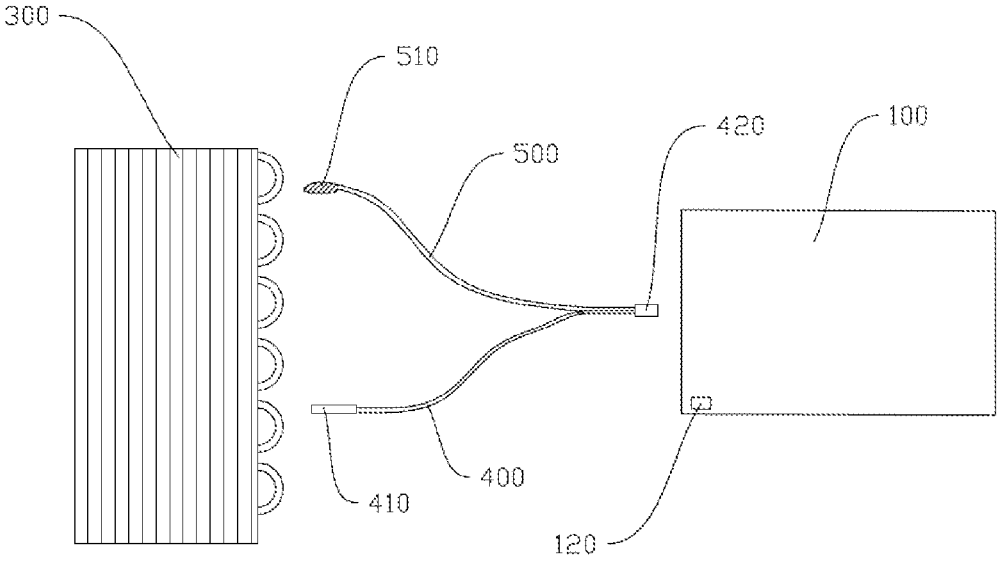
FIG. 3 is a schematic structural diagram of assembling a main board, a coil temperature sensor, a third temperature sensor, and an evaporator according to an embodiment of the present disclosure.

As shown in FIG. 3, in some embodiments of the present disclosure, the compressor control system further includes a coil temperature sensor 400 for detecting a tube wall temperature of at least one of an evaporator 300 and a condenser, where a second fixed-value resistor 520 is disposed in the coil temperature sensor 400, and the coil temperature sensor 400 is electrically connected to the main board 100 and transmits an electrical signal to the main board 100. A coil temperature-based NTC thermistor 2 on an existing common household air conditioner for detecting the tube wall temperature of at least one of the evaporator 300 and the condenser has a resistance that decreases with a temperature rise and increases with a temperature drop. When the coil temperature falls below 5° C., the resistance of the coil temperature-based NTC thermistor 2 increases with a temperature drop, so that the electrical signal transmitted to the main board 100 is a low-level signal, and the main board 100 controls the compressor 700 to stop operation. In other words, the compressor 700 does not perform refrigeration when the tube wall temperature of at least one of the evaporator 300 and the condenser is lower than 5° C. For the compressor 700 to operate normally when the tube wall temperature is lower than 0° C., the second fixed-value resistor 520 is disposed in the coil temperature sensor 400. A resistance of the second fixed-value resistor 520 does not change with the tube wall temperature, so that the electrical signal transmitted by the coil temperature sensor 400 to the main board 100 is always a high level signal. In this way, after the tube wall temperature of at least one of the evaporator 300 and the condenser falls below 5° C., the main board 100 does not control the power voltage input circuit 800 to be disconnected. It is ensured that when the tube wall temperature is lower than 0° C., the main board 100 can still control the power voltage input circuit 800 to be connected, so that the compressor 700 can operate normally at a tube wall temperature lower than 0° C., thereby providing a condition for transforming the common air conditioner into an air conditioner with a freezing function.

As shown in FIG. 3, in some embodiments of the present disclosure, the compressor control system further includes a third temperature sensor 500 for detecting an aluminum fin temperature of at least one of the evaporator 300 and the condenser, where the third temperature sensor 500 is electrically connected to a third fixed-value resistor, and the third temperature sensor 500 is electrically connected to the main board 100 and transmits an electrical signal to the main board 100. A fin temperature-based NTC thermistor on an existing common household air conditioner for detecting the aluminum fin temperature of at least one of the evaporator 300 and the condenser has a resistance that decreases with a temperature rise and increases with a temperature drop. When the aluminum fin temperature falls below 5° C., the resistance of the fin temperature-based NTC thermistor increases with a temperature drop, so that the electrical signal transmitted to the main board 100 is a low-level signal, and the main board 100 controls the compressor 700 to stop operation. In other words, the compressor 700 does not perform refrigeration when the aluminum fin temperature of at least one of the evaporator 300 and the condenser is lower than 5° C. For the compressor 700 to operate normally when the aluminum fin temperature is lower than 0° C., the third fixed-value resistor is disposed in the third temperature sensor 500. A resistance of the third fixed-value resistor does not change with the aluminum fin temperature, so that the electrical signal transmitted by the third temperature sensor 500 to the main board 100 is always a high level signal. In this way, after the aluminum fin temperature of at least one of the evaporator 300 and the condenser falls below 5° C., the main board 100 does not control the power voltage input circuit 800 to be disconnected. It is ensured that when the aluminum fin temperature is lower than 0° C., the main board 100 can still control the power voltage input circuit 800 to be connected, so that the compressor 700 can operate normally at the aluminum fin temperature lower than 0° C., thereby providing a condition for transforming the common air conditioner into an air conditioner with a freezing function.

As shown in FIG. 3, in some embodiments of the present disclosure, a coil temperature sensing probe 410 is disposed at one end of the coil temperature sensor 400, the second fixed-value resistor 520 is disposed in the coil temperature sensing probe 410, the other end of the coil temperature sensor 400 is connected to a second male connector 420, and a second female connector 120 that matches the second male connector 420 is disposed on the main board 100; and a third temperature sensing probe is disposed at one end of the third temperature sensor 500, the third fixed-value resistor is disposed in the third temperature sensing probe, and the other end of the third temperature sensor 500 is electrically connected to the second male connector 420. With such disposition, the coil temperature sensor 400 and the third temperature sensor 500 both can be electrically connected to the main board 100 only by plug-connecting the second male connector 420 to the second female connector 120 for coordination. In this way, a quantity of connectors can be reduced, and cables can be conveniently laid out. This makes the embodiments of the present disclosure much simpler, and facilitates maintenance.

In some embodiments of the present disclosure, a resistance of the second fixed-value resistor 520 is equal to a resistance of a coil temperature-based NTC thermistor 2 at 25° C., and a resistance of the third fixed-value resistor is equal to the resistance of the coil temperature-based NTC thermistor 2 at 25° C. The coil temperature-based NTC thermistor 2 is a temperature sensor on a common household air conditioner in an existing market for detecting the tube wall temperature of at least one of the evaporator 300 and the condenser. The resistance of the coil temperature-based NTC thermistor 2 decreases with a temperature rise and increases with a temperature drop. The coil temperature-based NTC thermistor 2 detects the tube wall temperature of at least one of the evaporator 300 and the condenser based on a specified operating state, so that the main board 100 can be used to control the compressor 700 to automatically start or stop, or convert a frequency. It should be noted that, a specified temperature range is generally 5° C.-30° C. Therefore, no refrigeration is performed at a tube wall temperature lower than 5° C., and no heating is performed at a tube wall temperature higher than 30° C. In the industry, the resistance of the coil temperature-based NTC thermistor 2 of an air conditioner at 25° C. is referred to as a nominal value. That is, the resistance of the coil temperature-based NTC thermistor 2 at 25° C. enables the electrical signal transmitted to the main board 100 to always stay at a high level. In a normal process, the compressor 700 sets the resistances of the second fixed-value resistor 520 and the third fixed-value resistor to be equal to the resistance of the coil temperature-based NTC thermistor 2 at 25° C. Therefore, the resistances of the second fixed-value resistor 520 and the third fixed-value resistor are constants and do not change with the tube wall temperature or the aluminum fin temperature, so that the electrical signals transmitted by the coil temperature sensor 400 and the third temperature sensor 500 to the main board 100 always stay at high levels. It is ensured that when at least one of the tube wall temperature and the aluminum fin temperature is lower than 0° C., the main board 100 can still control the power voltage input circuit 800 to be connected, so that the compressor 700 can operate normally at a tube wall temperature and/or an aluminum fin temperature lower than 0° C., thereby providing a condition for transforming the common air conditioner into an air conditioner with the freezing function.

Figure 1:
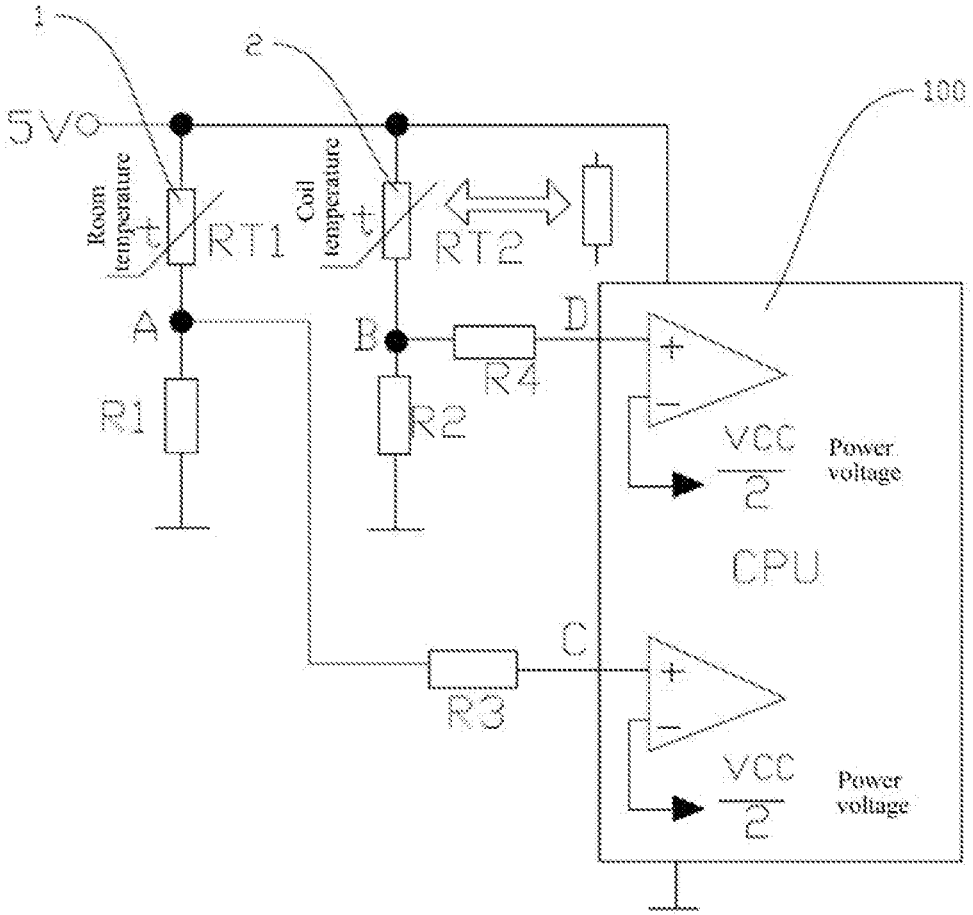
FIG. 1 is a schematic diagram of a compressor control circuit in an existing air conditioner.

As shown in FIG. 1, NTC thermistors commonly used by an air conditioner include three air conditioner sensors such as the indoor ambient temperature-based NTC thermistor 1, the indoor coil temperature-based NTC thermistor 2, and the fin temperature-based NTC thermistor of an aluminum fin. With the NTC thermistors in a circuit, a temperature change leads to an NTC thermistor resistance change and accordingly a voltage change of a CPU terminal. The CPU determines an operating state of the air conditioner based on the voltage change. An air conditioner temperature sensor complies with the following operating principle: After being serially connected to a resistor, the air conditioner temperature sensor divides a 5 V voltage (+3.3 V used by some air conditioners) and sends the divided voltage to the CPU. Air conditioner temperature sensors each adopt a negative temperature coefficient thermistor. To be specific, a resistance of the negative temperature coefficient thermistor decreases with a temperature rise and increases with a temperature drop. Therefore, the CPU complies with the following voltage input rule: An input voltage of the CPU increases with a temperature rise and decreases with a temperature drop. This variable voltage enters the CPU and is analyzed and processed to determine a current coil temperature or room temperature, and an operating state of the air conditioner is controlled through an internal program and manual settings. A sampling voltage sent to the CPU varies in a large range with a temperature. Therefore, subject to 25° C., a manufacturer generally designs the sampling voltage as a half of a power voltage during design, so as to provide sufficient room for a voltage change caused by a temperature change. If the sampling voltage is designed to be excessively high or low, a current temperature change cannot be properly reflected. Therefore, as shown in FIG. 5, in the embodiments of the present disclosure, the resistance of the indoor ambient temperature-based NTC thermistor 1 is replaced with that of the first fixed-value resistor 230, and the resistance of the coil temperature-based NTC thermistor 2 is replaced with that of the second fixed-value resistor 520. In this way, a resistance of the air conditioner temperature sensor in the improved control system of the present disclosure is a constant and does not change with a temperature, so that a voltage of the CPU terminal does not change with the temperature, and further the compressor 700 can operate normally at an indoor temperature lower than 0° C., thereby providing a condition for transforming the common air conditioner into an air conditioner with the freezing function. A specific refrigeration temperature can be accurately controlled by using the intelligent temperature controlled switch 900.

As shown in FIG. 2 to FIG. 5, according to embodiments of a second aspect of the present disclosure, an air conditioner for wide-range temperature adjustment includes the compressor 700, the evaporator 300, and the condenser that are sequentially connected through a duct to form a circulation loop, where an expansion valve is disposed between the evaporator 300 and the condenser, and the compressor 700 is controlled by any one of the foregoing control systems. Compared with the existing technology, in the embodiments of the present disclosure, the first temperature sensor 200 is electrically connected to the first fixed-value resistor 230, and the resistance of the first fixed-value resistor 230 is a constant. Relative to the characteristic that the resistance of the existing indoor ambient temperature-based NTC thermistor 1 decreases with a temperature rise and increases with a temperature drop, the resistance of the first fixed-value resistor 230 corresponding to the first temperature sensor 200 does not change with a temperature rise or drop, so that the electrical signal transmitted by the first temperature sensor 200 to the main board 100 is always a high-level signal, and after an indoor temperature falls below 15° C., the main board 100 does not control the power voltage input circuit 800 to be disconnected. It is ensured that when the indoor temperature is lower than 0° C., the main board 100 can still control the power voltage input circuit 800 to be connected, so that the compressor 700 can operate normally at an indoor temperature lower than 0° C. Further, in this way, the air conditioner in the embodiments of the present disclosure can perform refrigeration for the indoor temperature to fall below 0° C., featuring a wide temperature adjustment range. Compared with an existing common household air conditioner, the air conditioner in the embodiments of the present disclosure can not only implement a common refrigeration function but also be used as a freezer to perform refrigeration in a small confined space to reach −20° C., thereby reducing a fee needed for separately purchasing a freezer.

In some embodiments of the present disclosure, the evaporator 300 is a fin evaporator, and the condenser is a fin condenser. The fin condenser and the fin evaporator have a good heat exchange effect, and can improve energy efficiency. In addition, the coil temperature sensor 400 and the third temperature sensor 500 can respectively detect a copper tube wall temperature and an aluminum fin temperature conveniently.

The foregoing descriptions are merely example embodiments of the present disclosure, and are not intended to limit the present disclosure. For a person skilled in the art, the present disclosure can have various changes and variations. Any modification, equivalent replacement, or improvement made without departing from the spirit and principle of the present disclosure shall fall within the protection scope of the present disclosure.

I claim:

1. A compressor control system, comprising:

a power supply (600), configured to generate a power input voltage; a compressor (700), wherein a power voltage input circuit (800) is disposed between the compressor (700) and the power supply (600);

a main board (100), electrically connected to the power voltage input circuit (800), wherein during operation, the main board (100) is configured to control connection and disconnection of the power voltage input circuit (800); and a first temperature sensor (200), configured to detect an indoor temperature, wherein the first temperature sensor (200) is electrically connected to the main board (100) and transmits an electrical signal to the main board (100), and the first temperature sensor (200) is electrically connected to a first fixed-value resistor (230);

wherein a resistance of the first fixed-value resistor (230) is set to equal to a resistance of an indoor ambient temperature-based NTC thermistor at 25° C.

2. The compressor control system of claim 1, wherein a first temperature sensing probe (210) is disposed at one end of the first temperature sensor (200), the first fixed-value resistor (230) is disposed in the first temperature sensing probe (210), and a first male connector (220) is disposed at an end of the first temperature sensor (200) that is away from the first temperature sensing probe (210); and a first female connector (110) that matches the first male connector (220) is disposed on the main board (100).

3. The compressor control system of claim 1, wherein a first relay (810) is disposed in the power voltage input circuit (800), the first relay (810) is electrically connected between the main board (100) and the compressor (700), and upon power-on, the main board (100) controls the first relay (810) to be closed, so that the compressor (700) accesses the power supply (600) through the power voltage input circuit (800).

4. The compressor control system of claim 1, wherein an intelligent temperature controlled switch (900) is serially connected on a circuit between the power supply (600) and the first temperature sensor (200), and when an indoor temperature reaches a specified refrigeration temperature, the intelligent temperature controlled switch (900) controls the compressor (700) to stop operation.

5. The compressor control system of claim 1, further comprising a coil temperature sensor (400) for detecting a tube wall temperature of at least one of an evaporator (300) and a condenser, wherein a second fixed-value resistor (520) is disposed in the coil temperature sensor (400), and the coil temperature sensor (400) is electrically connected to the main board (100) and transmits an electrical signal to the main board (100).

6. The compressor control system of claim 5, further comprising a third temperature sensor (500) for detecting an aluminum fin temperature of the evaporator (300) and/or the condenser, wherein the third temperature sensor (500) is electrically connected to a third fixed-value resistor, and the third temperature sensor (500) is electrically connected to the main board (100) and transmits an electrical signal to the main board (100).

7. The compressor control system of claim 6, wherein a coil temperature sensing probe (410) is disposed at one end of the coil temperature sensor (400), the second fixed-value resistor (520) is disposed in the coil temperature sensing probe (410), the other end of the coil temperature sensor (400) is connected to a second male connector (420), and a second female connector (120) that matches the second male connector (420) is disposed on the main board (100); and a third temperature sensing probe is disposed at one end of the third temperature sensor (500), the third fixed-value resistor is disposed in the third temperature sensing probe, and the other end of the third temperature sensor (500) is electrically connected to the second male connector (420).

8. The compressor control system of claim 6, wherein a resistance of the second fixed-value resistor (520) is equal to a resistance of a coil temperature-based NTC thermistor at 25° C.; and a resistance of the third fixed-value resistor is equal to the resistance of the coil temperature-based NTC thermistor at 25° C.

9. An air conditioner for temperature adjustment, comprising a compressor (700), an evaporator (300), and a condenser that are sequentially connected through a duct to form a circulation loop, wherein an expansion valve is disposed between the evaporator (300) and the condenser, and the compressor (700) is controlled by the control system of claim 1.

10. An air conditioner for temperature adjustment, comprising a compressor (700), an evaporator (300), and a condenser that are sequentially connected through a duct to form a circulation loop, wherein an expansion valve is disposed between the evaporator (300) and the condenser, and the compressor (700) is controlled by the control system of claim 2.

11. An air conditioner for temperature adjustment, comprising a compressor (700), an evaporator (300), and a condenser that are sequentially connected through a duct to form a circulation loop, wherein an expansion valve is disposed between the evaporator (300) and the condenser, and the compressor (700) is controlled by the control system of claim 3.

12. An air conditioner for temperature adjustment, comprising a compressor (700), an evaporator (300), and a condenser that are sequentially connected through a duct to form a circulation loop, wherein an expansion valve is disposed between the evaporator (300) and the condenser, and the compressor (700) is controlled by the control system of claim 4.

13. An air conditioner for temperature adjustment, comprising a compressor (700), an evaporator (300), and a condenser that are sequentially connected through a duct to form a circulation loop, wherein an expansion valve is disposed between the evaporator (300) and the condenser, and the compressor (700) is controlled by the control system of claim 5.

14. An air conditioner for temperature adjustment, comprising a compressor (700), an evaporator (300), and a condenser that are sequentially connected through a duct to form a circulation loop, wherein an expansion valve is disposed between the evaporator (300) and the condenser, and the compressor (700) is controlled by the control system of claim 6.

15. An air conditioner for temperature adjustment, comprising a compressor (700), an evaporator (300), and a condenser that are sequentially connected through a duct to form a circulation loop, wherein an expansion valve is disposed between the evaporator (300) and the condenser, and the compressor (700) is controlled by the control system of claim 7.

16. An air conditioner for temperature adjustment, comprising a compressor (700), an evaporator (300), and a condenser that are sequentially connected through a duct to form a circulation loop, wherein an expansion valve is disposed between the evaporator (300) and the condenser, and the compressor (700) is controlled by the control system of claim 8.

* * * * *